US007847674B2

(12) United States Patent
Gerfast

(10) Patent No.: US 7,847,674 B2
(45) Date of Patent: Dec. 7, 2010

(54) TWO TERMINAL VARIABLE RESISTOR

(76) Inventor: Sten R. Gerfast, 1802 Valley Curve Rd., Mendota Heights, MN (US) 55118

( * ) Notice: Subject to any disclaimer, the term of this patent is extended or adjusted under 35 U.S.C. 154(b) by 1106 days.

(21) Appl. No.: 11/290,219

(22) Filed: Dec. 1, 2005

(65) Prior Publication Data

US 2007/0126549 A1 Jun. 7, 2007

(51) Int. Cl.
*H01C 10/12* (2006.01)

(52) U.S. Cl. ..... 338/114; 338/96

(58) Field of Classification Search ..... 338/114
See application file for complete search history.

(56) References Cited

U.S. PATENT DOCUMENTS 1,660,161 A * 2/1928 Hansen ..... 338/96
2,862,089 A * 11/1958 Mairs ..... 338/154
4,185,263 A * 1/1980 Frey ..... 338/301
4,257,305 A * 3/1981 Friend et al. ..... 84/690
4,333,068 A * 6/1982 Kishel ..... 338/158
6,891,465 B2 * 5/2005 Hatayama ..... 338/118
7,140,921 B2 * 11/2006 Liu ..... 439/638
7,190,251 B2 * 3/2007 Schrum et al. ..... 338/92

* cited by examiner

*Primary Examiner*—Elvin G Enad
*Assistant Examiner*—Joselito Baisa

(57) ABSTRACT

A small inexpensive two terminal variable resistance assembly that conveniently changes its resistance when a force of an actuator is applied. It can be made for power applications as well as in miniature dimension versions in values from milliohms to meg-ohms.

This variable resistor increases its power handling capacity during a decrease in its ohmic value, contrary to present three terminal potentiometers or reostats. It does this by a rolling action that increases or decreases two resistive surface areas in parallel. It could also be used as a variable capacitor.

20 Claims, 1 Drawing Sheet

TWO TERMINAL VARIABLE RESISTOR

FIELD OF THE INVENTION

This invention relates to resistors, potentiometers or rheostats that varies their value when actuated. It is small inexpensive two terminal variable resistor that can be used wherever resistive values have to be varied in electronic circuitry or electrical devices.

It can be made for power applications as well as in miniature dimension versions from milli ohm to mega ohm values. It does this by a rolling action that increases or decreases two resistive surface areas in parallel. This paralleling increases its power handling capability towards its lower ohms settings, contrary to present three terminal potentiometers.

It could also be used as a variable capacitor.

BACKGROUND

The present inventions two terminal variable resistor increases its power-handling-capacity during a decrease in its numerical ohm value, contrary to present potentiometers or rheostats, that decrease their power capability with decreasing numerical ohm values. Related art three terminal potentiometers or rheostats have two fixed terminals and a wiper terminal. When moving the wiper terminal towards lower resistance the wiper is approaching one of the fixed end terminals, and less and less resistive material is available between the wiper and the end terminal. As an example a 200 ohm potentiometer used on 12 volts is safe as long as its wiper position is in the 100 or 50 ohm position, but when the wiper is in the 12 ohm position Ohm's law states: volts divided by ohms=amps(1 amp×12 volts=12 watts). Most related art 2 watt or 5 watt potentiometers would be burned out by this time unless a safety resistor is added in series, that I have had to do before I came up with this invention.

The potentiometer with the safety resistor of course prevents the usage of varying the resistance down to lower readings; a definite disadvantage.

Another options to present day engineers are to buy and use a much larger and more expensive rheostat, but even so, if the rheostat in this example was turned to 3 ohm the wattage would be 48 watts. The above limitations of related art potentiometers are described when varying current in a DC circuit, but if it is used for AC operation, other restrictions such as peak voltage versus R.M.S. voltage have to also be considered.

The above stated shortcomings of present day potentiometers or rheostats are similar if either a rotary or a linear slide-type potentiometer is used. The linear type is also a 3 terminal device with two fixed terminals and a wiper manipulated by a sliding handle, with the same inherent problems as above.

SUMMARY OF THE INVENTION

The present inventions two terminal construction has no wiper.

It is varying the resistance between its two electrical terminals by increasing or decreasing the contact area between two conductive strips in parallel.

The increase in power handling is done with a rolling action of two adjacent strips with two active resistive surface areas, that increases or decreases the resistance when these strips are moved closer or further away from each other. It can be described as two adjacent strips forming a V-shape.

And said paralleling of more resistive material is taking place when the strips are in a "closed "V". This paralleling of resistance material causes a volume-increase of resistance material between its two terminals, that in turn causes lower ohms. Because of this increase in volume of resistance material, there is more material to handle the current at lower ohm settings.

Another advantage over previously available variable resistors, potentiometers and rheostats, that generally are of large physical size, is to decrease their size with the same performance. They generally also have many components. The present invention has only two terminals (three basic components) that can be made quite small, inexpensively and can be assembled by automation, either in the rotary or linear type construction The distance of contact between the strips, can be actuated with an actuator or spring member either in a rotating or sliding fashion.

The actuator could have a visual indicator mark showing the actuators position in a (transparent) frame, and the frame could have % markings showing what percentage of resistance is in contact.

Increased contact equals more active resistive material in parallel and a decrease of ohmic value as stated above.

This will add to the current capability of the present invention's variable resistor's power handling or wattage rating. The distant of contact can be either:

A. Starting as "an open "V" having "high" resistance; "actuating" to a closed "V" with "low" ohms, or B. Starting as "an closed "V" having "low" resistance; "actuating" to an open "V" with "high" ohms.

In the "B" embodiment it is preferred to have the "V"-shaped strips spring-loaded, or biased together, and the actuator separating or "opening up" the two spring-loaded strips.

Either embodiments does not preclude miniature size variable resistors to be manufactured in this design; and this construction can be used in electrical or electronic circuits that require varying resistive values ranging from milli-ohms to meg-ohms in many power ratings.

It could be described as a two terminal variable resistor with rolling action comprising:

- A resistive strip's two ends mounted on a non-conductive frame,
- a second resistive and resilient strip forming a curved V-shape connected to one end of said first strip,
- electrical connections applied at said first and second strips,
- wherein moving an actuator that increases or decreases the gap of said V-shape,
- also adds and subtracts resistive material, in parallel contact between two said strips.

It could also be described as more and more (or less and less as in "B") resistor material being connected in parallel across the strips until all the resistor material are in contact.

An actuator urging the two strips into mechanical and electrical parallel contact will then make the variable resistor approach a zero ohm condition.

The two strips could also be curved into a circular frame and the actuator could be of resilient wedge-shape and could be rotating. The actuator can take several forms, as simple as a slider, a semi-circle, a screw, turning of a knob or a motor turning a screw.

Related art three terminal potentiometers with wipers are series connected, and have been so connected since the potentiometer became popular in the "radio age of the 1920's".

The present invention appears to be novel 85 years later.

To the best of my knowledge "a two terminal potentiometer with two resistive strips and an actuator urging said strips into mechanical and electrical parallel contact" does not appear in any electronic catalog, either in the older yester-years brochures or today's catalogs.

Ohm's law states that the total resistance of resistors connected in parallel can be calculated as:

1 divided by . . . 1 over R1+1 over R 2+1 over R3 . . . etc

If, as an example, the present invention's resistive strip had 5 wire-wound resistive wires with each wire turn having a resistance of 1 ohm (a 5 ohm potentiometer) and the said second strip, as an example, was a conductive strip with a resistive coating; second strip contacting the first strip at it's last turns towards the zero ohm position, we have a working potentiometer. If we number these last turns 5, 4, 3, 2, and 1 . . . we can calculate the increase in current handling capability when more resistor material is in parallel. This is also shown in FIG. 3.

When the "last 5" wires are in contact between said two strips: R 5=5 ohms . . . 1 over 5=0.20 ohms R 4=4 0 hms=0.25 R 3=0.33 R 2=0.50 R 1=1.0 0.20+0.25+0.33+0.50+1=2.28 1 divided by 2.28=0.43 ohms. Plus a resistive component from the second strip that also touch the 5 turns on the first strip. So the present invention has five wires carrying the current when the potentiometer approaches zero ohms. This allows safe usage even at low ohms settings. In the related art 3 terminal (FIG. 4) potentiometer with a wiper (using same parameters) there is only one wire being touched by the wiper.

This one wire has to carry all the current when the potentiometer approaches zero ohms. It is when approaching the "lower ohm readings" that related art potentiometers overheats and burn out.

The present invention (in the above example) is spreading the current over 5 wires with approximately 5 times the current capability. And of course about five times the wattage capability compared to the wiper type.

This very simple assembly can be made in-expensively with miniature dimensions and also in power devices and still have excellent smooth up and down variable resistance values; better than the above mentioned related art potentiometers.

Another object of the present invention is to alleviate the above mentioned increased power dissipation towards the "low ohm" end-point of potentiometers, especially when it is operated close to its specified power or wattage rating.

The present invention adds more resistive material towards its "low ohm" end point where it is really needed to vary either current or voltage and to increase reliability.

The two terminal electrical connections are normally applied at said first and second strip, at their end points, but alternative placements of the connections at the open ends or at the closed ends of the V-shaped strips can provide for different resistance performance.

But in either case, added resistive material handles power dissipation much better than previous devices. The resistive material can have a linear "taper" or different tapers.

The second curved strip could be made of a conductive material or metal with a resistive coating with said curvature accomplished by an inherent spring bias in the material. In embodiment "B" the spring bias would be towards closing the "V" with a separating actuator. In embodiment "B" the separating actuator can be either a rotating type (as a partial-disc-shape as in FIG. 5) or it could have a sliding type (not shown). Actuation to increase or decrease the curvature in "A" embodiment can be done with a movable wedge-shaped part or spring member. The wedge-shaped part can be moved as a slide-function or by a screw-type arrangement.

The wedge-shape could also be replaced with a bi-furcated part straddling the two said strips to close them. If the present invention is intended for circuit board mounting, the above mentioned non-conductive frame can be replaced with a heat-conductive metal frame or a plate, having said two strips and the terminals insulated from the frame or from the plate.

The increased thermal conductivity of the metal into the copper layer on the circuit board is keeping the variable resistor cooler. If additional "non-conducting "terminals" is required for mechanical stability on the circuit board, it is important to remember that this invention has only two functional terminals with electrical connections.

An alternate usage of this invention could be to put a thin non-conducting membrane between the two V-shaped strips (with the strips in close relationship) [similar to "B"] which would then function as a two terminal variable capacitor.

Actuating the membrane into decreasing or increasing gap between the insulated strips, increases or decreases capacitance with a maximum capacitance of the variable capacitor at the decreased spacing. And this capacitance change would be done with greater power handling capability, with the capacitors in parallel, then in previous available related art rotating air-spacing type variable capacitor assemblies.

The strips in a capacitor application could be made from un-coated thin metal. A rotary actuator connected to the end of these un-coated strips with a thin insulator between them, similar to actuator as shown in FIG. 2 could have extended "rolling action ". This would increase its total capacitance capabilities. The rotary actuator, similar to FIG. 5, can have detents every few degrees to remain at the adjusted and desired capacitance value.

Embodiment "B" lends itself very well to usage as a variable capacitor, increasing and decreasing the capacity when the actuator varies the distance between the two strips. If the two strips also had a layer of resistive coating it would function as a "variable capacitor and variable resistance at the same instant" type of device. When the capacitance goes up, the capacitive reactance and the resistance goes up at the same time. It could possibly be used in an R/C network.

The term "resistive material" is interpreted to mean many different materials.

It could be made from an iron compound made into strips or it could be resistive wires or ribbons, made from iron-nickel compounds, that are used in electric resistance heaters.

These wires can be wound spaced apart, or close-wound on a strip or on both strips, wherein the strips could be conductive material with insulation or non-conductive materials.

This would also give the assembly a possibility of being used at high temperatures.

It can also be made from a resistive coating, generally with some thickness, on either a metal strip, semi-conductor material, an impregnated plastic strip or a carbon impregnated paper board.

A coating on the strips could be a combination of carbon, graphite, metal-impregnated adhesives or epoxies, metal oxides, or nitrides or similar conductive or semi-conducting materials.

Testing shows that strips with a carbon/graphite combination sprayed on metal is a very useful material. The above mentioned resistive coating could also be laid down in areas to give distinct resistive bands giving a stepped variable resistance when force is applied to the strips.

The strips could be made of similar or two different materials and could also have inherent resistive properties of the strip themselves without a coating. This wide range of material further adds to its useful application in its varied design configurations.

The term "mounted" is interpreted to mean adhesively mounted or mechanically mounted with snap-fits, with rivets, eyelets or fasteners either electrically conductive or not.

If an insulator is placed between two conductive strips, at one end, it provides for an infinite resistance in the non-compressed position, or "open V-shape", of the resilient strip.

When compression is started a resistance reading is given.

This could be used as a "Off" switch action on either end of the strips.

A conductive metal tab or eyelet, at an end, can also be used as "full On" (or zero ohm) switch action. If a slight divergent curvature of the resilient strip was followed by a convergent curve the convergent curvature would describe a wiping action on the other strip, similar to a feature sometimes called "wiping cleaning action" in switch assemblies.

Another embodiment of the present invention could be to use a small knob or electric motor to drive the actuator's screw-threads up and down, thereby increase and decrease the gap of the V-shape. The above descriptions and embodiments, that are shown, are not conclusive and could be easily modified and changed to include other forms, by a person skilled in the art.

DETAILED DESCRIPTION OF THE INVENTION

Figure 1:
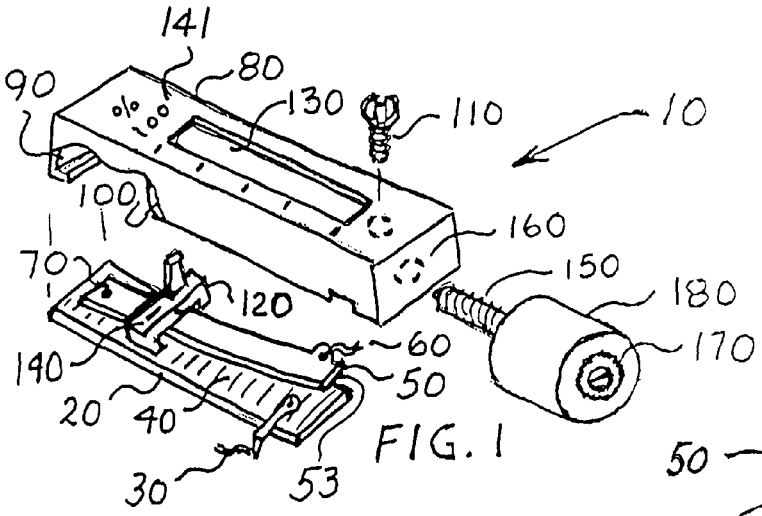
FIG. 1 is a composite drawing, partly broken out, and shown in exploded view, of three slightly different embodiments of the present invention.

FIG. 1 is a composite drawing as an exploded view of variable resistors in differing embodiments. When similar parts are used in different figures, the reference numbers on these similar parts are given the same reference numbers.

The first description is of the smallest, simplest and least expensive variable resistor assembly 10 of the present invention. It has a first strip 20 with an electrical connection 30 also connected to a coating 40, a second resilient strip 50 with electrical connection 60 and a conductive coating 53 on the side facing the first strip 20, with both strips connected together at 70.

Strip 20 and strip 50 are also mounted together on frame 80 with a snap-fit 90 shown towards the broken out section 100.

A simple actuator screw 110 is shown in a position to be able to decrease spacing between the "V" shaped" assembly of strip 20 and strip 50.

FIG. 1 is a second description that is also a view of basically the same variable resistor assembly 10, wherein the screw 110 is replaced by a slider 120 protruding through an opening 130, that could be partially covered by a transparent cover, and shows an index mark 140 on the slider 120. The index mark 140 in turn shows the percentage 141 of resistance in use.

FIG. 1 discussed as a third description, is also a view of basically the same variable resistor assembly 10, wherein the actuation is accomplished by a screw-thread 150 that is shown in a possible position to engage the same slider 120, and a nut 160 attached to frame 80.

The screw-thread 150 and the nut 160 can reciprocate the same slider actuator 120.

The screw-thread could have a slotted end, or have an attached knob 170, or be driven by a reversible motor 180.

Figure 2:
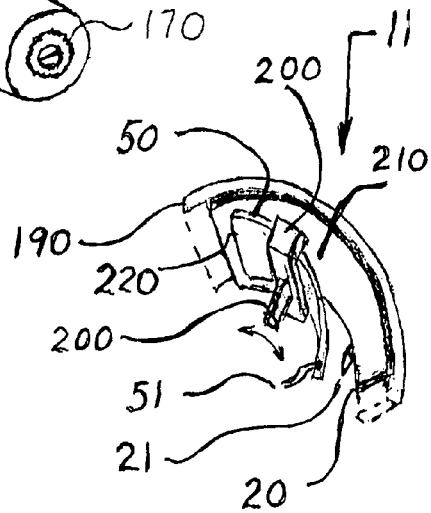
FIG. 2 is another embodiment showing a rotating type variable resistor and its actuator.

FIG. 2 is a top view of a rotating type actuator variable resistor 11 with a resistive strip 20 with electrical connection at 21, formed into a circular sector fitted into a round frame 190 with a resilient, resistive second strip 50 with electrical connection at 51, said second strip 50 also formed into a curved "V"-shape, fitting inside the first strip 20. Centered in this assembly is a rotating actuator 200 that increases or decreases the gap 210 between strip 20 and strip 50. The two strips are connected together at 220.

Figure 3:
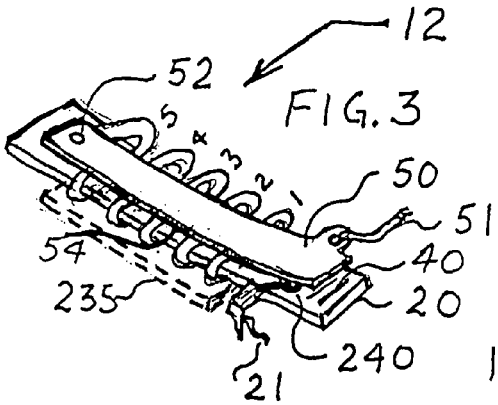
FIG. 3 shows a wire or ribbon-wound variable resistor with its second strip and its actuator.

FIG. 3 is a variable resistor 12 of the present invention having a resistive strip 20 with electrical connection at 21, with 5 wire or ribbon-wound turns 5, 4, 3, 2 and 1 on said strip 20, a second strip 50 with electrical connection at 51, and a conductive coating 54 on the side facing the first strip 20, with contact between first strip 20 and strip 50 at point 52. Also shown is that strip 50 is in contact with the turns 5, 4, 3, 2 and 1 on strip 20.

Also shown on strip 20 is a "zero-ohm" contact 240 for a "full On" switch section, at the end of the strips. Under the strip 20 is a plate 235, that could be a heat-conductive plate, insulated from strip 20, conducting heat away from the resistive wires on strip 20.

Figure 4:
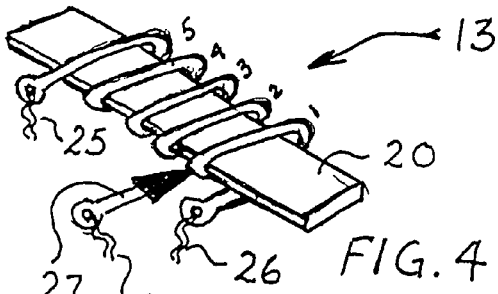
FIG. 4 RELATED ART
FIG. 4 is a related art, three terminal variable resistor with a wiper.

FIG. 4 is a related art, variable resistor 13 having a resistive strip 20 with a first electrical connection at 25 and also having a second electrical connection at 26, with 5 wire or ribbon-wound turns 5, 4, 3, 2 and 1 on said strip 20.

A third electrical connection is at 28 connected to a wiper 27 that is positioned at turn number1, showing the current path from electrical connection 26 through the wiper 28 through one turn.

Figure 5:
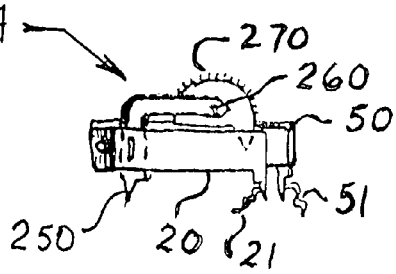
FIG. 5 is a side view of a variable resistor with a separating-type actuator.

FIG. 5 is a variable resistor 14 of the present invention having a resistive strip 20 with electrical connection at 21, that is also serving as a mechanical mount, with a second resistive strip 50 with electrical connection at 51, that is also serving as a mechanical mount, with said second strip 50 spring-biased towards said first strip 20.

A non-electrical mounting tab 250 is positioned on the opposite edge from the two electrical tabs 21 and 51.

This non-electrical mounting tab 250 also has a pivot 260 for a rotating partial-disc-shaped actuator that is serving as a separating actuator 270 positioned between strip 20 and strip 50.

This separating actuator 270 increases or decreases the gap of said "V" shape that also adds and subtracts resistive material in parallel contact between two said strips.

The embodiment shown would lend itself to a small circuit board mounted "trimmer" variable resistor. If the strip 20 and strip 50 would be made without resistive material, and a thin insulator would be placed between strips 20 and 50 it would serve as a variable capacitor.

The illustrations of the present invention that are shown are by no means conclusive of how the invention can be used. A person skilled in the art could easily make many other different configurations and uses for this invention. It should be understood that the intention is not to limit the invention to the particular embodiments described. With the present trend of miniaturization this invention with sizes ranging from mini to macro is therefore very timely.

The invention claimed is:

1. A two terminal variable resistor with rolling action comprising:

a first resistive strip's two ends mounted on a non-conductive frame, a second resistive and resilient strip forming a curved V-shaped gap when connected in series to one end of said first strip, electrical connections applied at said first and second strips, wherein moving an actuator that increases or decreases the gap of said V-shape, also increases and decreases resistive portions in parallel contact between two said resistive strips, said increases of resistive portions in parallel contact conjoin the resistance of two said strips, with further decrease in said gap substantially conjoins total resistance of two said strips.

2. The variable resistor of claim 1 wherein said first and second resistive strips are joined in a series connection and said actuator thereafter is urging said first and second resistive strips into mechanical and electrical parallel contact increasing power handling capability and decreasing ohmic value of said strips.

3. The variable resistor of claim 1 wherein said actuator is formed as a resilient wedge-shape urging an increase or a decrease of said V-shaped gap.

4. The variable resistor of claim 1 wherein said actuator is manually reciprocated by a screw-thread and nut with said screw-thread having a knob.

5. The variable resistor of claim 1 wherein said actuator is reciprocated by reversible electric motor.

6. The variable resistor of claim 1 wherein said one or both resistive strips are manufactured from, or wound with, wires or ribbons containing iron, nickel or compounds thereof.

7. The variable resistor of claim 1 wherein said two resistive strips and their electrical connections are solely two and said variable resistor has no wiper.

8. The variable resistor of claim 1 wherein said actuator is having a visual mark indicating its position and percentage of resistance in contact.

9. The variable resistor of claim 1 wherein said two resistive strips in a V-shape are spring biased to their substantially closed position and said actuator is a separating-type actuator.

10. The variable resistor of claim 9 wherein said two resistive strips have varying separation, an insulator between said two resistive strips and said separation also varies the capacitance between said two resistive strips.

11. The variable resistor of claim 9 wherein said resistive strips are resistance coated and have varying separation and said separation varies both capacitance and resistance between said two resistive strips at the same time.

12. The variable resistor of claim 9 wherein said separating-type actuator is either rotating or sliding.

13. A two terminal variable resistor with rolling action comprising:

a first resistive strip formed into a circular sector with its two ends mounted on a non-conductive frame, a second conductive and resilient strip forming a curved V-shaped gap when connected in series to one end of said first strip, electrical connections applied at said first and second strips, wherein rotating an actuator that increases or decreases the gap of said V-shape, also increases and decreases resistive portions in parallel contact between two said resistive strips, said increases of resistive portions in parallel contact conjoin the resistance of two said strips, with further decrease in said gap substantially conjoins total resistance of two said strips.

14. The variable resistor of claim 13 wherein said first and second resistive strips are joined in a series connection and said actuator thereafter is urging said first and second resistive strips into mechanical and electrical parallel contact increasing power handling capability and decreasing ohmic value of said strips.

15. The variable resistor of claim 13 wherein said one or both resistive strips are having coatings of resistive materials containing one or more of carbon, graphite, oxides, nitrides, or conductive epoxies.

16. The variable resistor of claim 15 wherein said coating is sprayed on, using a carbon/graphite mixture in beat resistant paint.

17. The variable resistor of claim 13 wherein said second resistive strip is made from conductive spring material.

18. The variable resistor of claim 13 wherein said two resistive strips and their electrical connections are solely two and said variable resistor has no wiper.

19. The variable resistor of claim 13 wherein either of said resistive strips are having conductive, non-resistive contact areas at said resistive strips ends to accomplish either On or Off switching.

20. The variable resistor of claim 13 wherein said second resistive strip is having a slight divergent curvature followed by slight convergent curvature.

* * * * *